US005421641A

United States Patent [19]

Wermuth

[11] Patent Number: 5,421,641

[45] Date of Patent: Jun. 6, 1995

[54] POWERED TOOL FOR SLICING OR SHEARING ROOFING MATERIAL

[76] Inventor: Michael D. Wermuth, 527 Cleveland Rd., Waterloo, Wis. 53594

[21] Appl. No.: 99,730

[22] Filed: Jul. 30, 1993

[51] Int. Cl.[6] ..... E21C 47/00

[52] U.S. Cl. ..... 299/10; 172/15; 299/36

[58] Field of Search ..... 30/170; 81/45; 299/36, 299/37, 10; 15/93.1, 93.3; 172/15, 17, 777, 795, 798; 173/24

[56] References Cited

U.S. PATENT DOCUMENTS

| | | | |
|---|---|---|---|
| 1,371,064 | 3/1921 | Agneni . | |
| 1,732,941 | 10/1929 | Lennon . | |
| 1,909,752 | 5/1933 | Calkins . | |
| 2,195,481 | 4/1940 | Dreisbaugh . | |
| 2,327,930 | 8/1943 | Ranney . | |
| 3,448,812 | 6/1964 | Peters | 172/15 |
| 3,486,228 | 12/1969 | James . | |
| 3,695,713 | 10/1972 | Rothi et al. | 299/37 |
| 3,917,350 | 11/1975 | Bricher | 299/36 X |
| 4,977,673 | 12/1990 | Altizer . | |
| 5,002,629 | 3/1991 | Nahamura | 30/170 X |
| 5,199,784 | 3/1993 | Holder | 30/170 X |

*Primary Examiner*—Douglas D. Watts

*Attorney, Agent, or Firm*—Andrus, Sceales, Starke & Sawall

[57] ABSTRACT

An apparatus and method for slicing roofing material includes a prime mover in the form of a powered tractor, and a slicing assembly mounted to the rear end of the tractor. The slicing assembly includes a frame mounted to the tractor, a blade mounted to the frame, and a raising and lowering assembly for raising and lowering the rear end of the tractor, which in turn controls the position of the blade relative to the roof. The raising and lowering assembly includes a support member such as a wheel, and is pivotably mounted to the frame for movement between a raised position, providing penetration of the blade into the roofing material, and a lower position for maintaining the blade above the roofing material. A retainer mechanism is interconnected between the frame and the support assembly for selectively maintaining the support assembly in its lower position. A stop assembly is interconnected with the frame for controlling the angular position of the support assembly relative to the frame, to thereby control the amount of vertical movement of the support assembly relative to the rear end of the tractor and the amount of penetration of the blade into the roofing material.

12 Claims, 3 Drawing Sheets

POWERED TOOL FOR SLICING OR SHEARING ROOFING MATERIAL

BACKGROUND AND SUMMARY

This invention relates to an apparatus for slicing or shearing roof membranes to prepare them for removal. In this application, it is understood that the terms slicing and shearing have the same meaning in the context of preparing roofing materials for removal.

Built-up commercial roofing material, which typically must be removed prior to installation of a new roof, often includes asbestos, which has been recognized as a potentially hazardous material requiring care in its removal. To protect workers, current regulatory rules require that strict precautions must be taken in removing asbestos roofing material. These regulations are most stringent if asbestos fibers are emitted during removal of a roof of this type. Such regulations mandate that protective equipment be used by workers if fiber counts exceed certain levels, and also mandate extra steps in the removal process; steps not required if fiber levels o are kept low. As can be appreciated, compliance with such regulations significantly increases labor and equipment costs, making this type of work relatively expensive and time-consuming.

In the past, it has been known to utilize a rotary saw to cut the roofing material into sections, which are then removed from the roof. However, use of a saw results in generation of a substantial amount of dust and debris. When asbestos-containing roofing material is cut with a rotary saw, it then becomes necessary to comply with the most stringent regulations governing asbestos roof removal as set forth above.

Accordingly, it is an object of the present invention to provide an apparatus to prepare roofing material for removal, particularly roofing material including asbestos, which results in generation of no dust or debris which otherwise would trigger operation of the most restrictive asbestos removal regulations. It is a further object of the invention to provide a method of preparation for roof removal which is relatively simple and efficient, enabling an operator to lower the time and expense involved in roofing material removal.

In accordance with one aspect of the invention, a powered tool for slicing or shearing built-up roofing is operated on the roofing material to slice or shear the roofing material into sections, which are then removed. Slicing or shearing of the roofing material eliminates generation of dust or other particles into the air, thus avoiding the effect of the most burdensome regulations governing removal of asbestos roofing material. The powered tool includes a hand-operated prime mover including a power source, one or more wheels operatively connected to the power source, and a manual control for selectively transmitting power to the wheels from the power source for moving the prime mover along the roof. A slicing mechanism is mounted to the prime mover, including a blade and an arrangement for mounting the blade to the slicing mechanism. A raising and lowering assembly is interconnected with the prime mover for selectively raising the blade above the roofing material and selectively lowering the blade into the roofing material. The mounting arrangement for mounting the blade to the slicing mechanism includes a frame connected to the prime mover, and the blade is preferably rigidly fixed to the frame. The frame may be fixed in any location on the prime mover, and representatively may be fixed to its rearward end. The raising and lowering assembly functions to move the rearward end of the prime mover upwardly and downwardly relative to the roofing material for raising and lowering the blade relative to the roofing material. The raising and lowering assembly is interconnected with the frame, and includes a support member such as a wheel or skid, and a bracket assembly to which the support member is connected. The bracket assembly is pivotably mounted to the frame, and a manually operable handle is interconnected with the bracket assembly for controlling the angular position of the bracket assembly and the support member relative to the frame to thereby control the vertical position of the prime mover, and thereby the cutting blade, relative to the roof. A retainer arrangement is interposed between the bracket assembly and the frame for selectively maintaining the support member in a lower position in which the blade is raised above the roofing material. An adjustable stop mechanism is interposed between the frame and the bracket assembly for adjusting the upper position of the support member relative to the frame, to thereby control the depth of penetration of the blade into the roofing material when the blade is lowered into the roofing material by movement of the bracket assembly and support member between its lower and upper positions.

The invention further contemplates a method of preparing roofing material for removal, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
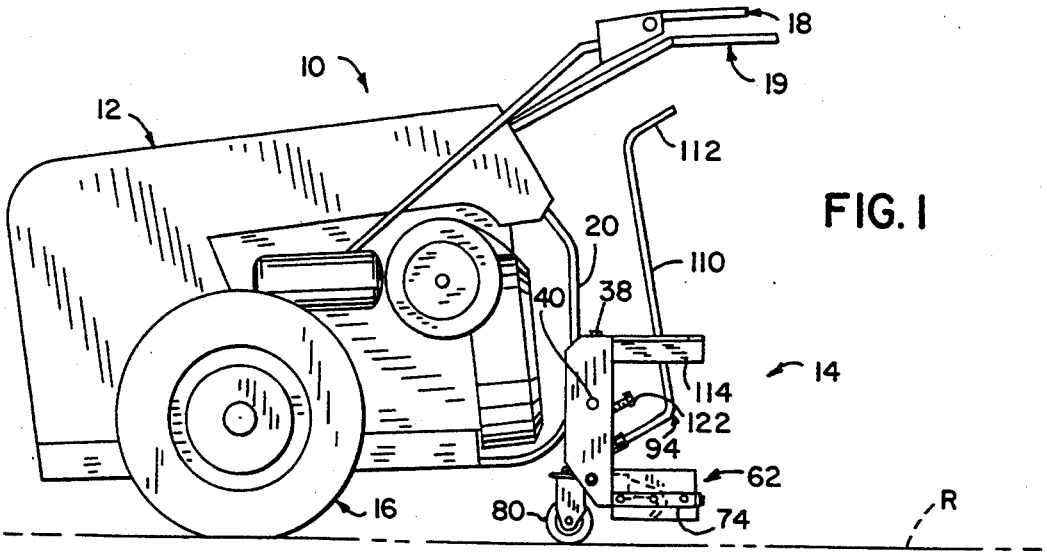
FIG. 1 is a side elevation view showing the roofing slicing apparatus of the present invention.

Referring to FIG. 1, a roofing slicing apparatus 10 includes a prime mover in the form of a conventional manually operated powered tractor 12, and a slicing assembly 14 mounted to tractor 12. Tractor 12 includes a pair of wheels 16 operatively connected with a power source such as an internal combustion engine (not shown) or the like, and a manually operated control 18 located adjacent a handle 19 for selectively transferring power from the power source to wheels 16 for moving tractor 12 along a surface. In FIG. 1, tractor 12 is shown as being supported by a roof R.

Figure 2:
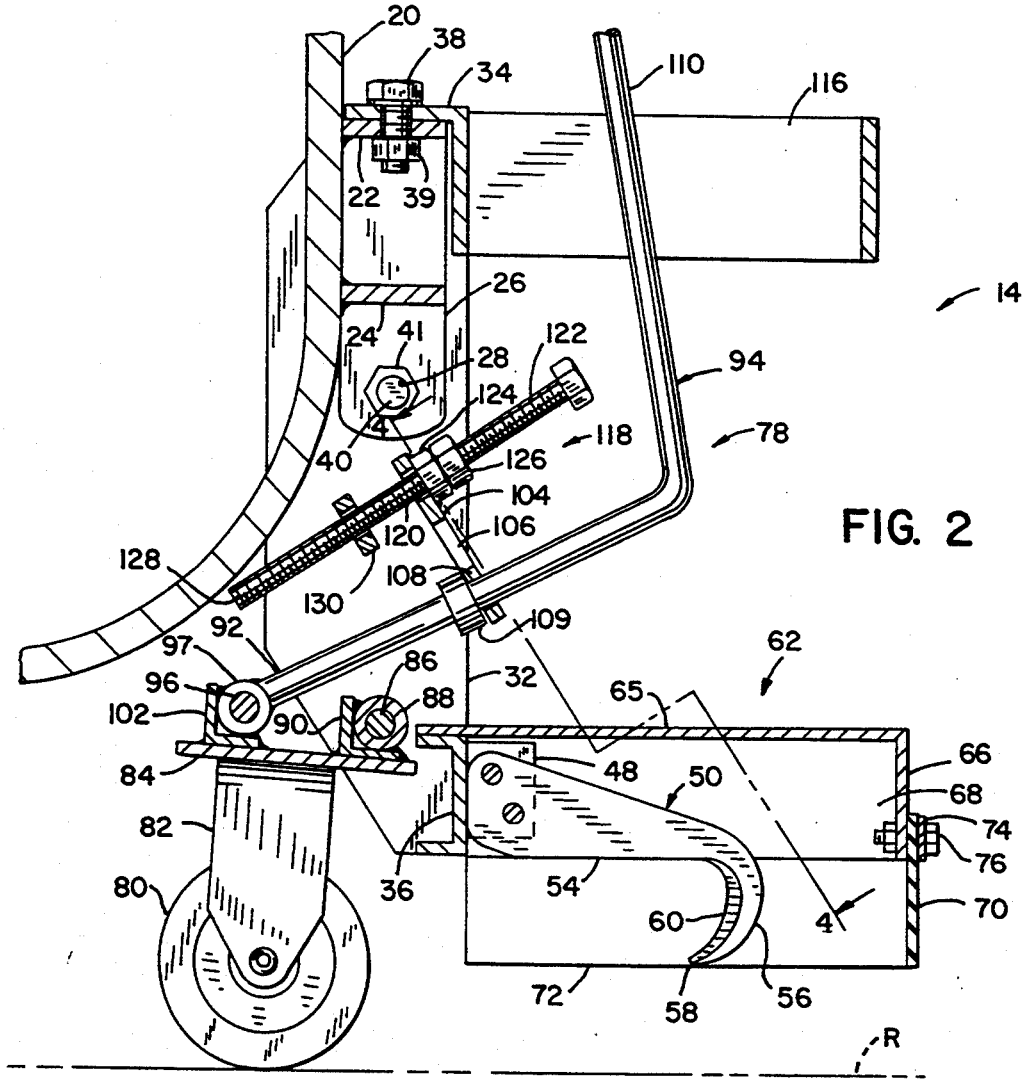
FIG. 2 is an enlarged partial side elevation view showing the components of the apparatus of FIG. 1 which function to slice the roofing material upon movement of the apparatus of FIG. 1 along a roof, showing the blade in its raised position.

Referring to FIGS. 1 and 2, tractor 12 includes a draw bar 20 and a hitch assembly, consisting of a pair of upper and lower plates 22, 24, respectively, and pair of side plates 26. Each side plate 26 includes a lower opening 28. In a manner to be explained, slicing assembly 14 is mounted to draw bar 20 and the hitch assembly of tractor 12.

Slicing assembly 14 includes a frame consisting of a pair of side plates 30, 32, an upper angle crossmember 34 interconnecting the upper ends of side plates 30, 32, and a lower channel cross-member 36 interconnecting the lower ends of side plates 30, 32. Upper hitch plate 22 includes an opening, and an opening is formed in the upper leg of upper angle cross-member 34 in alignment with the opening formed in upper hitch plate 22. A bolt 38 extends through the opening formed in upper angle cross-member 34 and through the opening formed in upper hitch plate 22 into engagement with a nut 39 located adjacent upper hitch plate 22. Similarly, openings are formed in frame assembly side plates 30, 32 in alignment with the openings 28 formed in hitch assembly side plates 26. Mounting bolts 40 (FIGS. 1, 2) extend through the openings in frame assembly side plates 30, 32 and through the openings 28 formed in hitch assembly side plates 46, into engagement with nuts 41. With this arrangement, bolts 38, 40 function to secure slicing assembly 14 to tractor 12 through the hitch assembly and draw bar 20 of tractor 12.

The above description and its associated drawings pertain to mounting of slicing assembly 14 to one particular configuration of a tractor hitch. It is understood that slicing assembly 14 may be adapted in a conventional manner for mounting to any other type of hitch arrangement provided on any satisfactory prime mover, or in a similar fashion to the frame of the prime mover.

A pair of angle sections 42, 44 (FIGS. 2, 4) are mounted to the web of lower frame cross member 36. Angle sections 43, 44 define spaced, rearwardly extending legs 46, 48, respectively, which face each other. A blade 50 is mounted between legs 46, 48 via a pair of bolts 52 and mating nuts, with bolts 52 extending through aligned openings formed in legs 46, 48 and in the forward end of blade 50. Blade 50 is a hook-type blade, including an upper elongated triangular portion 54 and a depending hook portion 56 defining a lower point 58 and a forwardly facing curved cutting edge 60.

A blade shield assembly 62 rests on the upper flange of lower frame cross member 36 and is mounted to a pair of angle sections 63, 64 (FIG. 4) mounted to cross member 36, for enclosing blade 50 to prevent accidental contact therewith. Blade shield assembly 62 includes a top wall 65, a depending rear wall 66 and a pair of side walls 68. Blade shield assembly 62 further includes lower resilient rear and side walls 70, 72, respectively, which are interconnected with rear and side walls 66, 68, respectively through mounting strips 74 and bolt and nut assemblies, each of which includes a bolt, such as 76, extending through one of a series of aligned openings formed in mounting strip 74 and in the lower portions of rear and side walls 66, 68, respectively. Bolts 76 function to secure blade shield side walls 68 to angle sections 63, 64 through openings (not shown) formed in the rearwardly extending legs of angle sections 63, 64.

A raising and lowering mechanism, shown generally at 78, is interconnected with the frame of slicing assembly 14 for selectively raising blade 50 above roof R and lowering blade 50 into and through the material of roof R. Raising and lowering mechanism 78 includes a support member, shown in the drawings as a wheel 80 rotatably mounted to a bracket 82. Bracket 82 is mounted to a plate 84, which in turn is pivotably interconnected between frame assembly side plates 30, 32 by means of a shaft 86 fixed at its ends to side plates 30, 32. Shaft 86 extends through a sleeve 88, and plate 84 is secured to sleeve 88 through an angle member 90 which is rigidly mounted, such as by welding or the like, to both plate 84 and sleeve 88. Shaft 86 thus defines the pivot axis about which plate 84, and thus wheel 80 and its mounting bracket 82, are pivotably mounted between frame assembly side plates 30, 32.

While the support member is shown in the drawings as wheel 80, it is understood that any other satisfactory support member could be used in place of wheel 80, such as a pivoting skid or other similar device which can both function to support the rear end of tractor 12 and provide movement of slicing assembly 14 along roof R.

Figure 3:
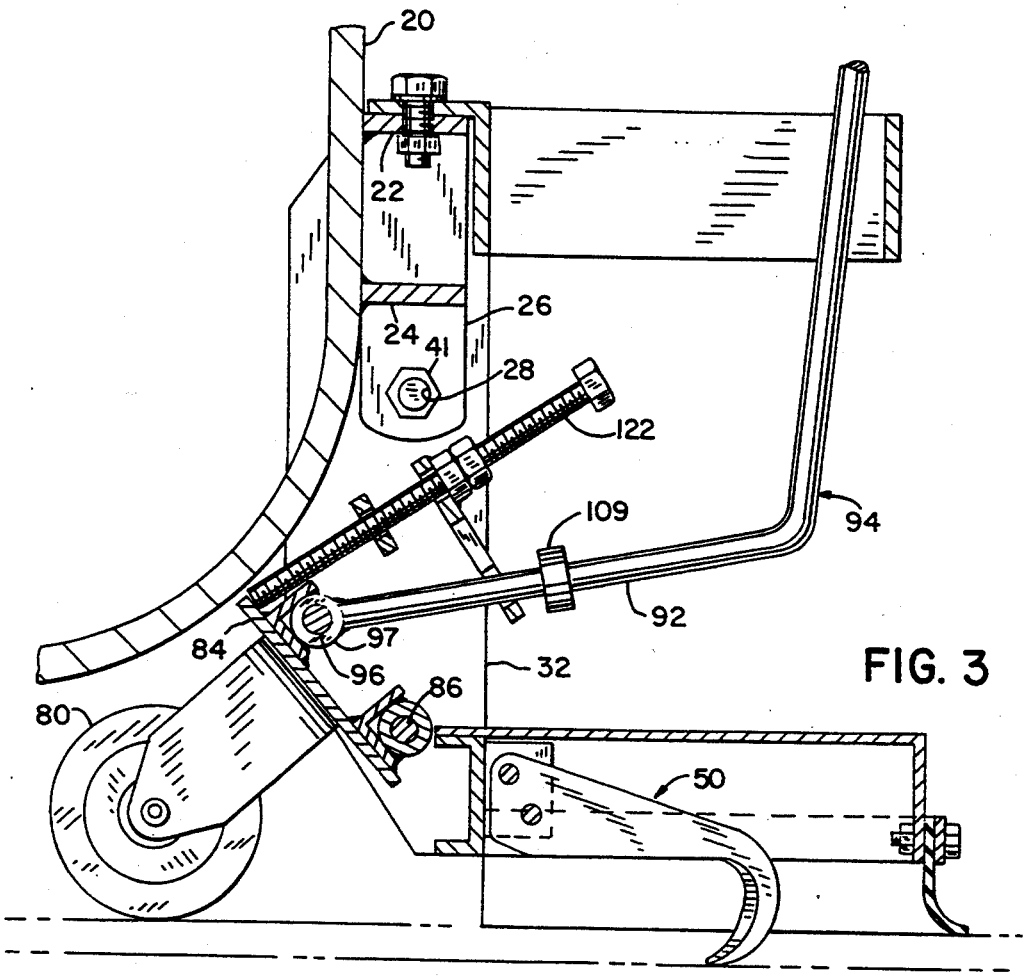
FIG. 3 is a view similar to FIG. 2, showing the blade in its lowered position to penetrate the roofing material.
Figure 4:
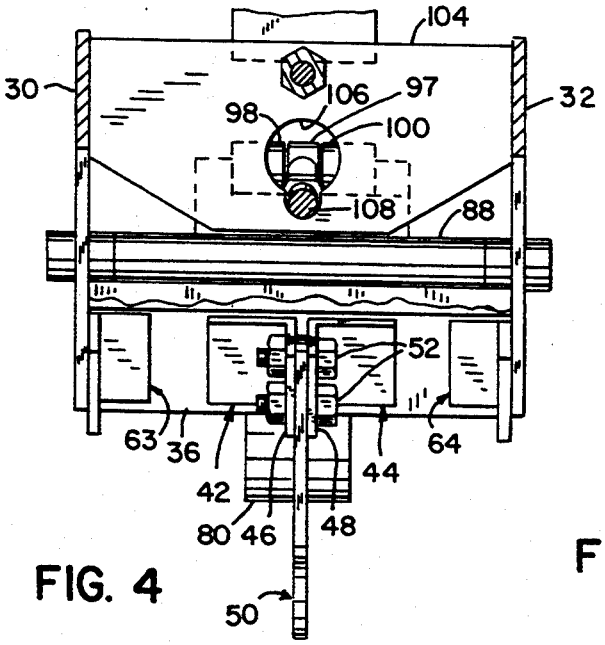
FIG. 4 is a partial section view taken along line 4—4 of FIG. 2.

As a means for selectively retaining wheel 80 in its lowered position of FIG. 2 and for providing pivoting movement of plate 84, and wheel 80 to their raised position of FIG. 3, the lower portion 92 of a handle 94 is pivotably mounted to the forward end of plate 84. The end of handle lower portion 92 is welded to a sleeve 97 (FIGS. 3, 4) surrounding a pin 96, which in turn extends between and is locked with set screws to a pair of set collars 98, 100 (FIGS. 2, 4). Collars 98, 100 are mounted to plate 84 through an angle member 102 secured, such as by welding or the like, to both plate 84 and to bushings 98, 100. An angled plate 104 extends between frame assembly side plates 30, 32. As shown in FIGS. 2 and 4, an opening is formed in plate 104, defining an upper enlarged portion 106 and a lower restricted portion 108. Handle lower portion 92 extends through the opening formed in plate 104, and is movable therein between upper enlarged portion 104 and lower restricted portion 108 upon pivoting movement of handle lower portion 92 about the pivot axis defined by pin 96. A collar 109 is fixed to lower portion 92 of handle 94 in the vicinity of plate 104. In a manner to be explained, movement of handle lower portion 94 within the opening in plate 104, and the interaction of collar 109 with plate 104, functions to selectively retain wheel 80 in its lowered position of FIG. 2 and allow movement of wheel 80 to its raised position of FIG. 3 under the weight of tractor 12.

Handle 94 further includes an elongated central portion 110 and an upper portion 112 (FIG. 1). Handle central portion 110 is disposed within a space defined between a pair of guide members, in the form of angle sections 114, 116 connected to and extending rearwardly from the vertical leg of frame assembly upper cross member 34. Angle members 114, 116 are spaced apart a distance only slightly greater than the diameter of handle central portion 110, for preventing lateral side-to-side movement of handle 94.

A stop assembly, shown generally at 118, is interconnected with plate 104. Stop assembly 118 includes an opening 120 formed in plate 104, through which a threaded bolt 122 extends. Bolt 122 is threadedly engaged with a nut 124 mounted to plate 104 over opening 120. A second nut 126 is engaged with bolt 122, and is movable on bolt 122 for selectively engaging nut 124 to lock bolt 122 in a desired position relative to plate 104. The outer end 128 of bolt 122 extends through an opening in a plate 130, which functions to prevent bolt 122 from bending. As shown in FIG. 3, outer end 128 of bolt 122 is adapted to engage the upper surface of plate 84, to act as a stop for maintaining plate 84, and thereby wheel 80, in a desired angular position relative to frame assembly side plates 30, 32.

In operation, roofing slicing apparatus 10 functions as follows. First, roofing slicing apparatus 10 is placed onto roof R, and handle 94 is placed into its FIG. 2 position to maintain blade 50 in a raised position relative to roof R by maintaining plate 84, and thereby wheel 80, in its lowered, FIG. 2 position. This serves to elevate the rear end of tractor 12, allowing tractor 12 to be moved to a desired position on roof R. Handle lower portion 92 is received within restricted lower portion 108 of the opening in plate 104, and collar 109 engages plate 104 to retain plate 84 and wheel 80 in their lowered position. When it is desired to slice the roofing material of roof R, the operator grasps upper portion 112 of handle 94 and pivots handle 94 in a counterclockwise direction, which results in handle lower portion 92 being moved out of restricted portion 108 of the opening formed in plate 104 and into enlarged opening portion 106. With handle 94 in its counterclockwise rotated position, the weight of tractor 12 causes plate 84 and wheel 80 to pivot about shaft 86 in a clockwise direction, and collar 109 passes through opening enlarged portion 106. Plate 84 and wheel 80 are thus moved to their raised position of FIG. 3, which functions to lower the rear end of tractor 12 toward roof R. As the lower end of tractor 12 is lowered toward roof R, point 58 of blade 50 pierces the material of roof R and penetrates therethrough to a desired depth, as shown in FIG. 3. The upper surface of plate 84 engages outer end 128 of stop bolt 122 to limit the clockwise pivoting movement of plate 84 relative to frame assembly side plates 30, 32, to thereby maintain wheel 80 in a desired vertical position relative to the rear end of tractor 12. In this manner, the depth of penetration of blade 50 into the material of roof R is controlled by the axial position of stop bolt 122 relative to plate 104. To attain a shallower depth of penetration of blade 50, the operator turns bolt 122 relative to nut 124 to extend bolt outer end 128 a greater distance from plate 104, to thereby provide a lesser amount of vertical movement of wheel 80 relative to frame assembly side plates 30, 32. To increase the depth of penetration of blade 50, the operator turns bolt 122 relative to nut 124 to draw bolt outer end 128 toward plate 104, thus providing an increase in the vertical distance traveled by wheel 80 during pivoting movement and increasing the amount of penetration of blade 50 into the material of roof R. The operator then utilizes manual control 18 of tractor 12 to move tractor 12 along the surface of roof R, during which cutting edge 60 of blade 50 functions to slice the material of roof R. The operator continues operation of slicing apparatus 10 to cut the material of roof R into sections, which are then removed from the underlying substrate of roof R.

The slicing of the material of roof R by cutting edge 60 of blade 50 results in the material of roof R being cut without emission of any of the roofing material or generation of dust. Shield assembly 62 functions to protect the operator from exposure to blade 60.

When the operator is finished with slicing of the material of roof R and it is desired to withdraw blade 50 from the material of roof R, the operator lifts up on tractor handle 19 to raise the rear end of tractor 12. While this occurs, the weight of wheel 80, bracket 82 and plate 84 will normally cause pivoting movement of such components about shaft 86 and draw collar 109 through opening 106 in plate 104. Alternatively, if such movement of components 80–84 is prevented such as due to the presence of dirt or the like, the operator may grasp upper end 112 of handle 94 and rotates handle 94 in a counterclockwise direction to align collar 109 with opening enlarged portion 106, allowing collar 109 to pass therethrough as the rear end of tractor 12 is raised. The operator then moves handle 94 in a clockwise direction to move handle lower end 92 adjacent collar 109 into opening restricted portion 108, and lowers the rear end of tractor 12 toward roof R to rest the weight of the rear end of tractor 12 on wheel 80. Collar 109 then engages plate 104 adjacent opening restricted portion 108, to again maintain slicing apparatus 12 in its inoperative, travel position as shown in FIG. 3.

Figure 5:
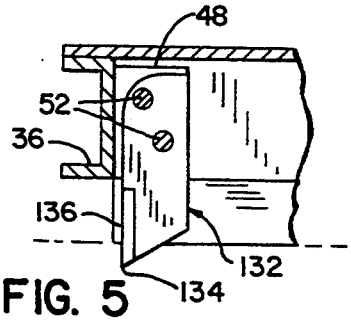
FIGS. 5, 6 and 7 are partial side elevation views illustrating alternative embodiments for the blade for the apparatus of FIGS. 1–4.

FIG. 5 illustrates an alternative blade 132 which can be used in place of hook-type blade 50. Blade 132 is substantially vertical, defining a point 134 and a forward vertical cutting edge 136 extending upwardly from point 134. Blade 132 is mounted between legs 46, 48 in the same manner as blade 50, and functions similarly to slice the material of roof R during movement of tractor 12 along roof R.

Figure 6:
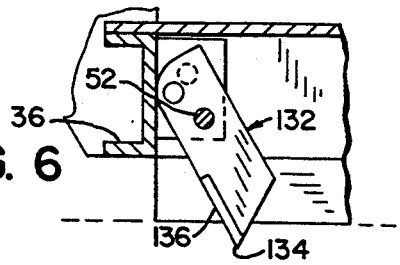

FIG. 6 illustrates an alternative manner for mounting blade 132 between legs 46, 48. In the embodiment of FIG. 6, only the lower one of bolts 52 is used to secure blade 132 between legs 46, 48. This functions to pivotably mount blade 132 between legs 46, 48, thus allowing blade 132 to pivot in a counterclockwise direction until engagement of the upper end of blade 132 with the web of lower frame cross member 36. This provides a rearward slant to cutting edge 136. Alternatively, using a different pattern of holes in blade 132, blade 132 can be mounted therebetween so as to slant forwardly. Thus, the operator can utilize either a forwardly directed, vertical or rearwardly directed cutting edge to slice the material of roof R, according to operating conditions and operator preference.

Figure 7:
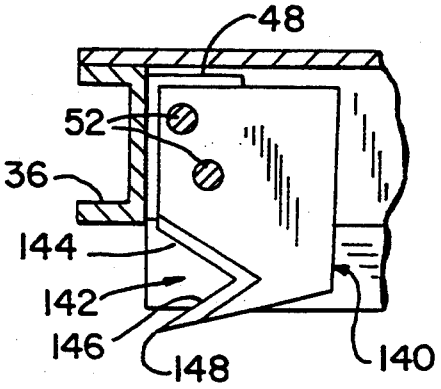

FIG. 7 illustrates yet another alternative blade 140 which can be used in place of hook-type blade 50 or straight-edge blade 132. Blade 140 is mounted in a manner similar to that of blade 50 and blade 132 in FIG. 5, and includes a forwardly facing V-shaped notch or mouth 142 formed in its lower forward portion. Notch or mouth 142 defines edges 144, 146 oriented at an acute angle relative to each other, and the area of blade 140 adjacent edges 144, 146 is sharpened. Blade 140 further defines a sharpened point 148 at the lowermost end of its forward edge, which is operable to pierce the roofing material upon lowering of slicing apparatus 14 as described. Sharpened edges 144, 146 function to slice the material of roof R during movement of tractor 12 along roof R. It has been found that a blade shaped as blade 140 provides advantageous strength and wear capabilities while functioning in a highly satisfactory manner to slice roofing material.

Various alternatives and embodiments are contemplated as being within the scope of the following claims particularly pointing out and distinctly claiming the subject matter regarded as the invention.

I claim:

1. A powered tool for slicing roofing material, comprising:

a hand-operated prime mover including a power source, one or more wheels operatively connected to the power source, and a manual control for selectively transmitting power to the wheels from the power source for selectively moving the prime mover along the roof; and an arrangement for slicing roofing material mounted to the prime mover, comprising a frame mounted in a fixed vertical position to the prime mover; a blade rigidly fixed to the frame; a support member movably mounted to the frame and engageable with the roofing material for supporting the prime mover thereabove, the support member being vertically movable between a first position in which the prime mover is lowered toward the roofing material to engage the blade with the roofing material, and a second position in which the prime mover is raised relative to the roofing material to raise the blade thereable; and a control arrangement interconnected with the frame and the support member for controlling movement of the support member between its first and second position is, wherein the support member is pivotably mounted to the frame, and wherein the control arrangement comprises a manually operable handle interconnected with the support member for controlling the angular position of the support member relative to the frame to control the vertical position of the prime mover, and thereby the blade, relative to the roofing material.

2. The tool of claim 1, wherein the support member comprises rotatably mounted to a bracket assembly pivotably mounted to the frame.

3. The tool of claim 1, wherein the blade comprises a hook-type blade having a forward end rigidly interconnected with the prime mover through the frame, and a depending rearward end defining a lower point and a forwardly facing curved sharpened slicing edge extending upwardly from the lower point.

4. The tool of claim 1, wherein the blade comprises a plate-like blade interconnected with the frame and defining a lower point and a forwardly facing linear sharpened slicing edge extending upwardly from the lower point.

5. A powered tool for slicing roofing material, comprising:

a hand-operated prime mover including a power source, one or more wheels operatively connected to the power source, and a manual control for selectively transmitting power to the wheels from the power source for selectively moving the prime mover along a roof;

an arrangement for slicing roofing material mounted to the prime mover, comprising a frame mounted to the prime mover, a blade rigidly fixed to the frame, a mounting arrangement for mounting the blade to the prime mover, and a raising and lowering assembly interconnected with the prime mover and the blade for selectively lowering the blade into the roofing material and raising the blade above the roofing material, wherein the raising and lowering assembly functions to move the prime mover upwardly and downwardly for moving the blade upwardly and downwardly relative to the roofing material, wherein the raising and lowering assembly is interconnected with the frame and comprises a support member, a bracket assembly to which the support member is mounted, wherein the bracket assembly is pivotably mounted to the frame, and a manually operable handle interconnected with the bracket assembly for controlling the angular position of the bracket assembly relative to the frame to control the vertical position of the prime mover, and thereby the blade, relative to the roofing material; and an adjustable stop for controlling the depth of penetration of the blade into the roofing material, comprising a stop plate mounted to the bracket assembly and a threaded member threadedly mounted to the frame for selective axial movement relative thereto, wherein the threaded member engages the stop plate upon pivoting movement of the bracket assembly for stopping pivoting movement of the bracket assembly in a predetermined angular position, to control the vertical position of the prime mover according to the position of the threaded member relative to the frame.

6. A powered tool for slicing roofing material, comprising:

a hand-operated prime mover including a power source, one or more wheels operatively connected to the power source, and a manual control for selectively transmitting power to the wheels from the power source for selectively moving the prime mover along a roof; and an arrangement for slicing roofing material mounted to the prime mover, comprising a frame mounted to the prime mover, a blade rigidly fixed to the frame, a mounting arrangement for mounting the blade to the prime mover, and a raising and lowering assembly interconnected with the prime mover and the blade for selectively lowering the blade into the roofing material and raising the blade above the roofing material, where the raising and lowering assembly functions to move the prime mover upwardly and downwardly for moving the blade upwardly and downwardly relative to the roofing material, wherein the raising and lowering assembly is interconnected with the frame and comprises a support member, a bracket assembly to which the support member is mounted, wherein the bracket assembly is pivotably mounted to the frame, and a manually operable handle interconnected with the bracket assembly for controlling the angular position of the bracket assembly relative to the frame to control the vertical position of the prime mover, and thereby the blade, relative to the roofing material, wherein the manually operable handle includes a lower end pivotably mounted to the bracket assembly, and further comprising a retainer arrangement for selectively retaining the prime mover in a predetermined upper vertical position relative to the roofing material to maintain the blade thereabove, comprising a collar mounted to the handle adjacent its lower end and space therefrom, and a plate interconnected with the frame, the plate having an opening through which the handle extends, the opening including a first portion accommodating passage of the collar therethrough and a second portion accommodating passage of the handle therethrough and providing engagement of the collar with the plate adjacent the second portion of the opening, wherein pivoting movement of the handle relative to the bracket assembly results in movement of the handle between the first and second portions of the opening.

7. A powered tool for slicing roofing material, comprising:

a hand-operated prime mover including a power source, one or more wheels operatively connected to the power source, and a manual control for selectively transmitting power to the wheels from the power source for selectively moving the prime mover along the roof; and an arrangement for slicing roofing material mounted to the prime mover, comprising a frame mounted in a fixed vertical position to the prime mover; a blade rigidly fixed to the frame; a support member movably mounted to the frame and engageable with the roofing material for supporting the prime mover thereabove, the support member being vertically movable between a first position in which the prime mover is lowered toward the roofing material to engage the blade with the roofing material, and a second position in which the prime mover is raised relative to the roofing material to raise the blade thereabove; and a control arrangement interconnected with the frame and the support member for controlling movement of the support member between its first and second positions, wherein the blade comprises a plate-like blade interconnected with the frame and defining a lower point and a forwardly facing notch defining a pair of sharpened slicing edges oriented at an acute angle relative to each other, the notch defining a lower point.

8. A powered tool for slicing roofing material, comprising:

a hand-operated prime mover including a power source, one or more wheels operatively connected to the power source, and a manual control for selectively transmitting power to the wheels from the power source for selectively moving the prime mover along a roof, wherein the prime mover defines a forward end and a rearward end;

a frame mounted to the prime mover;

a blade having a depending sharpened forwardly facing slicing edge mounted to the frame;

a support member movably mounted to the frame for supporting the prime mover, the support member being movable between an upper position operable to lower the prime mover relative to the roofing material to allow the blade to penetrate the roofing material, and a lower position operable to raise the prime mover relative to the roofing material to raise the blade thereabove;

a retainer arrangement interposed between the frame and the support member for selectively maintaining the support member in its lower position for maintaining the blade above the roofing material; and an adjustable mechanism interposed between the frame and the support member for adjusting the raised position of the support member relative to the frame for adjusting the depth of penetration of the blade into the roofing material.

9. A method of preparing roofing material for removal, comprising the steps of:

providing a roofing slicing apparatus comprising: a prime mover having a power source, one or more wheels operatively connected to the power source, and a manual control for selectively transmitting power to the wheels from the power source; a slicing blade; a frame for interconnecting the blade with the prime mover; and a raising and lowering assembly interconnected with the blade and the prime mover for selectively raising and lowering the blade relative to the roofing material;

placing the roofing slicing apparatus on a roof;

selectively lowering the blade to penetrate the roofing material by operation of the raising and lowering assembly;

moving the roofing slicing apparatus along the roof with the blade penetrating the roofing material by selective operation of the manual control, wherein the blade function is to slice the roofing material during movement of the roofing slicing apparatus for slicing the roofing material into sections;

retaining the blade in a raised position relative to the roofing material by engagement of a support member with the roofing material, and wherein the step of selectively lowering the blade to penetrate the roofing material comprises vertically moving the support member relative to the prime mover for lowering the blade into the roofing material; and adjusting the depth of penetration of the blade into the roofing material by controlling the vertical movement of the support member relative to the prime mover.

10. The method of claim 9, wherein the step of adjusting the vertical position of the support member relative to the prime mover comprises adjusting the position of a threaded stop member threadedly engaged with the frame, wherein the stop member is engageable with the support member during upwardly vertical movement of the support member relative to the frame.

11. The method of claim 9, wherein the step of retaining the blade in a raised position relative to the roofing material comprises moving a handle between first and second positions, the handle extending through an opening formed in a transverse frame member and including a collar connected thereto, wherein the opening includes a first portion accommodating passage of the collar therethrough and a second portion accommodating passage of the handle therethrough while providing engagement of the collar with the transverse frame member adjacent the second portion of the opening, wherein movement of the handle to its second position functions to place the handle in the second portion of the opening, and wherein engagement of the collar with the transverse frame member adjacent the second portion of the opening functions to retain the support member in a vertical position relative to the frame member for maintaining the blade in a raised position above the roofing material.

12. The tool of claim 1, further comprising an adjustment mechanism mounted to the frame and engageable with the support member for adjusting the vertical movement of the support member to adjust the depth of penetration of the blade into the roofing material.

* * * * *

UNITED STATES PATENT AND TRADEMARK OFFICE

CERTIFICATE OF CORRECTION

PATENT NO. : 5,421,641

DATED : June 6, 1995

INVENTOR(S) : MICHAEL D. WERMUTH

It is certified that error appears in the above-identified patent and that said Letters Patent is hereby corrected as shown below:

In The Claims

Claim 1, col. 7, line 13, delete "thereable" and substitute therefor -- thereabove --; Claim 1, col. 7, line 17, delete "position is" and substitute therefor -- positions--; Claim 2, col. 7, line 27, after "comprises" insert -- a wheel --; Claim 6, col. 8, line 31, delete "where" and substitute therefor -- wherein --.

Signed and Sealed this

Twenty-ninth Day of August, 1995

*Attest:*

*Attesting Officer*

BRUCE LEHMAN

*Commissioner of Patents and Trademarks*